US006077654A

United States Patent [19]

Merrill et al.

[11] Patent Number: 6,077,654

[45] Date of Patent: Jun. 20, 2000

[54] COLOR MOTION PICTURE PRINT FILM WITH DESATURATED COLOR SPACE

[75] Inventors: James P. Merrill, Rochester; Mitchell J. Bogdanowicz, Spencerport; Charles P. Hagmaier, Rochester, all of N.Y.

[73] Assignee: Eastman Kodak Company, Rochester, N.Y.

[21] Appl. No.: 09/219,693

[22] Filed: Dec. 23, 1998

[51] Int. Cl.[7] ..... G03C 7/18; G03C 7/22

[52] U.S. Cl. ..... 430/502; 430/360; 430/503; 430/508; 430/934

[58] Field of Search ..... 430/502, 503, 430/508, 934

[56] References Cited

U.S. PATENT DOCUMENTS

| | | | |
|---|---|---|---|
| 5,491,053 | 2/1996 | Barber et al. | 430/549 |
| 5,750,320 | 5/1998 | Bogdanowicz et al. | 430/383 |
| 5,888,706 | 3/1999 | Merrill et al. | 430/383 |
| 5,891,607 | 4/1999 | Brewer et al. | 430/383 |
| 5,985,529 | 11/1999 | Bogdanowicz et al. | 430/502 |

OTHER PUBLICATIONS

B. Bergery, "Refelctions:The Lab, Part II", American Cinematographer, May 1993, pp. 74–78.

*Primary Examiner*—Hoa Van Le
*Attorney, Agent, or Firm*—Andrew J. Anderson

[57] ABSTRACT

A silver halide light sensitive motion picture photographic print element is disclosed comprising a support bearing on one side thereof: a primarily yellow dye image-forming unit comprising at least one blue-sensitive silver halide emulsion layer having associated therewith primary yellow dye-forming coupler and secondary cyan and magenta dye-forming couplers; a primarily cyan dye image-forming unit comprising at least one red-sensitive silver halide emulsion layer having associated therewith an effectively primary amount of cyan dye-forming coupler and effectively secondary amounts of magenta and yellow dye-forming couplers; and a primarily magenta dye image-forming unit comprising at least one green-sensitive silver halide emulsion layer having associated therewith an effectively primary amount of magenta dye-forming coupler and effectively secondary amounts of cyan and yellow dye-forming couplers; wherein the primary and secondary dye-forming couplers in each of the dye image-forming units are present in amounts effective to obtain a ratio of Equivalent Neutral Density for the dyes formed from each of the primary dye-forming couplers to each of the secondary dye-forming couplers in each dye-image forming unit of from 20:1 to 3:2 in the print film upon exposure and processing in the standard ECP-2B motion picture color print process, such ratios measured at an exposure resulting in an Equivalent Neutral Density of 1.0 for the primary image dye color of the respective unit. Color print film silver halide photographic elements with mixed color dye image-forming couplers in each of the dye image-forming units thereof enable the production of projected images having desired black densities and colored images having desired degrees of color saturation.

12 Claims, 10 Drawing Sheets

COLOR MOTION PICTURE PRINT FILM WITH DESATURATED COLOR SPACE

FIELD OF THE INVENTION

The invention relates to a color motion picture print silver halide photographic film, and more particularly to such a film having modified color saturation. The invention modifies the range color reproduction that may be realized from conventional processing of a print film.

BACKGROUND

Color negative origination silver halide photographic films are a class of photosensitive materials that map the luminance (neutral) and chrominance (color) information of a scene to complementary tonal and hue polarities in the negative film. Upon exposure and development of the film to form dye images from photographic couplers incorporated in the film, light areas of the scene are recorded as dark areas on the color negative film, and dark areas of the scene are recorded as light areas on the color negative film. Colored areas of the scene are typically recorded as complementary colors in the color negative film: red is recorded as cyan, green is recorded as magenta, blue is recorded as yellow, etc. In order to render an accurate reproduction of a scene, a subsequent process is necessary to reverse the luminance and chrominance information back to those of the original scene. In the motion picture industry, one such subsequent process is to optically print (by contact or optics) the color negative film onto another negative working photosensitive silver halide material which produces dye images upon exposure and development, such as a motion picture silver halide print film, to produce a color positive image suitable for projection.

Historically, color print silver halide photographic materials, such as EASTMAN EXR Color Print Film 5386™, have been optimized to yield pleasing projected plants when used in conjunction with color negative origination silver halide photographic materials as discussed above. That is, the sensitometric properties of print materials are co-optimized by considering the properties of the printing device to be used and the nature of a representative color negative tone scale to be printed, such as that of KODAK VISION 500T Color Negative Film 5279™. When a motion picture color negative is printed on motion picture color print stock, the sensitometric properties of the two materials combine to yield an acceptable scene reproduction in the print film when projected on a theater screen. To facilitate obtaining optimal reproductions, guidelines exist regarding the exposure of the camera original negative (for example see American Cinematographer Manual, Dr. Rod Ryan Ed., $7^{th}$ Edition, The ASC Press, Hollywood, Calif., 1993, pp128–141.), exposure of the print stock (LAD—Laboratory Aim Density KODAK Publication No. H-61), and projector/screen luminance levels (Society of Motion Picture and Television Engineers (SMPTE) Standard 196M-1995).

In order to obtain a high quality visual image in an optical photographic print, the contrasts for each color record of the negative film and print film designed for producing optical prints are conventionally maintained within certain ranges (e.g., mid-scale contrasts of about 0.45–0.7 for negative films and about 2.5–3.1 for print films), as too low a contrast may result in production of flat-looking positive print images with black tones rendered as smokey-grey and white tones rendered as light gray, while too high a contrast may result in poor flesh tone reproductions and loss of shadow detail. Pictures such as these would not be pleasing to view and would be deemed to be of low quality in the industry.

Correct exposure of camera negative originals has long been emphasized not only to ensure that critical scene information is properly recorded but also so that when the negative is printed on a photographic print film according to trade practice, scene blacks are sufficiently dense in the resulting projected prints. The importance of obtaining substantial black densities is such that cinematographers often over-expose camera negatives as a means of obtaining good blacks. Dense camera originals require higher light levels to be used in the printing step. When the printing light is increased, the exposure delivered to the photographic print film from the Dmin area of the camera film is higher, resulting in greater dye generation upon photographic processing and resulting higher black densities. This effect is well known in the trade (American Cinematographer Manual, p281). Even with overexposure techniques, however, maximum equivalent neutral (i.e., visual) densities obtainable for conventional silver halide photographic print films are generally limited to about 3.8, where the Equivalent Neutral Density of any particular dye color record is defined as the visual density that results when the other two dyes are added in quantities just sufficient to produce a neutral gray (see, e.g., "Procedures for Equivalent-Neutral-Density (END) Calibration of Color Densitometers Using a Digital Computer", by Albert J. Sant, in the Photographic Science and Engineering, Vol. 14, Number 5, September–October 1970, pg. 356). Over-exposures additionally can result in loss of highlight detail in a resulting print.

Special photographic film image processing techniques are also known in the art for raising black density levels in conventional photographic silver halide print materials, such as by-passing the bleach step present in normal print processing so as to retain developed silver (see, e.g., B. Bergery, "Reflections: The Lab, Part II", American Cinematographer, May 1993, pp. 74–78). The retained silver increases print opacity yielding higher black densities, with an accompanying loss of color saturation. The bleach by-pass process has become popular in the motion picture industry, as in addition to giving an increase in black density, it also results in a decrease in color saturation, which cinematographers may use to obtain a desired "desaturated" color look in the resulting processed print to help establish certain moods with a film. Given the need for large throughput in the creation of theatrical release prints, however, non-standard processing associated with bleach by-pass is burdensome and impractical.

Copending, commonly assigned U.S. application Ser. No. 08/931,010, now U.S. Pat. No. 5,888,706 the disclosure of which is incorporated by reference herein, discloses color-coupled silver halide photographic print film elements which enable higher black densities and color saturation, while also providing good flesh and shadow-detail reproduction. This is achieved through design of a color print film silver halide photographic element having sufficiently high silver and coupler levels and overall contrast values in the color records to obtain relatively high maximum densities, where comparatively high upper-scale contrast values are used while maintaining relatively low mid-scale contrast values. Such elements may be used in current printers and processors to obtain such properties without requiring any modifications to standard exposure and development processes. Such elements, however, do not provide the desaturated color look associated with bleach by-pass processing of conventional print films.

U.S. Pat. No. 5,491,053 discloses the use of image dye-forming coupler mixing in motion picture films in order to achieve a "chromogenic" black and white (i.e., color neutral) image upon processing with a color developing agent. The neutral images obtained therein are intended to replicate black and white film images conventionally obtained by developing exposed silver halide in a black-and-white developer (such as hydroquinone) to form a silver image.

It would be desirable to provide a color-coupled silver halide photographic color print film element which would enable a desaturated color image, while also desirably providing good flesh contrast and shadow reproduction. It would be further desirable to provide such an element which may be used with conventional printer set-ups and standard processing conditions.

SUMMARY OF THE INVENTION

One embodiment of the invention comprises a silver halide light sensitive motion picture photographic print element comprising a support bearing on one side thereof: a primarily yellow dye image-forming unit comprising at least one blue-sensitive silver halide emulsion layer having associated therewith primary yellow dye-forming coupler and secondary cyan and magenta dye-forming couplers; a primarily cyan dye image-forming unit comprising at least one red-sensitive silver halide emulsion layer having associated therewith an effectively primary amount of cyan dye-forming coupler and effectively secondary amounts of magenta and yellow dye-forming couplers; and a primarily magenta dye image-forming unit comprising at least one green-sensitive silver halide emulsion layer having associated therewith an effectively primary amount of magenta dye-forming coupler and effectively secondary amounts of cyan and yellow dye-forming couplers; wherein the primary and secondary dye-forming couplers in each of the dye image-forming units are present in amounts effective to obtain a ratio of Equivalent Neutral Density for the dyes formed from each of the primary dye-forming couplers to each of the secondary dye-forming couplers in each dye-image forming unit of from 20:1 to 3:2 in the print film upon exposure and processing in the standard ECP-2B motion picture color print process, such ratios measured at an exposure resulting in an Equivalent Neutral Density of 1.0 for the primary image dye color of the respective unit.

A further embodiment of the invention comprises a process of forming an image in a motion picture silver halide light sensitive photographic print element as described above comprising exposing the silver halide light sensitive photographic print element to a color negative film record, and processing the exposed photographic print element to form a developed color image having a ratio of Equivalent Neutral Density for the dyes formed from each ol the primary dye-forming couplers to each of the secondary dye-forming couplers in each dye-image forming unit of from 20:1 to 3:2 measured at an exposure resulting in an Equivalent Neutral Density of 1.0 for the primary image dye color of the respective unit.

ADVANTAGES

We have found that color print film silver halide photographic elements with mixed color dye image-forming couplers in each of the dye image-forming units thereof enable the production of projected images having desired black densities and colored images having desired degrees of color saturation. Where the print films also have relatively low mid-scale contrast values and comparatively high upper-scale contrast values in accordance with U.S. Ser. No. 08/931,010 referenced above, optimal mid-scale contrasts may be obtained in color print images having controlled color saturation while maintaining high overall contrast and corresponding high maximum densities.

DETAILED DESCRIPTION OF THE INVENTION

Figure 1:
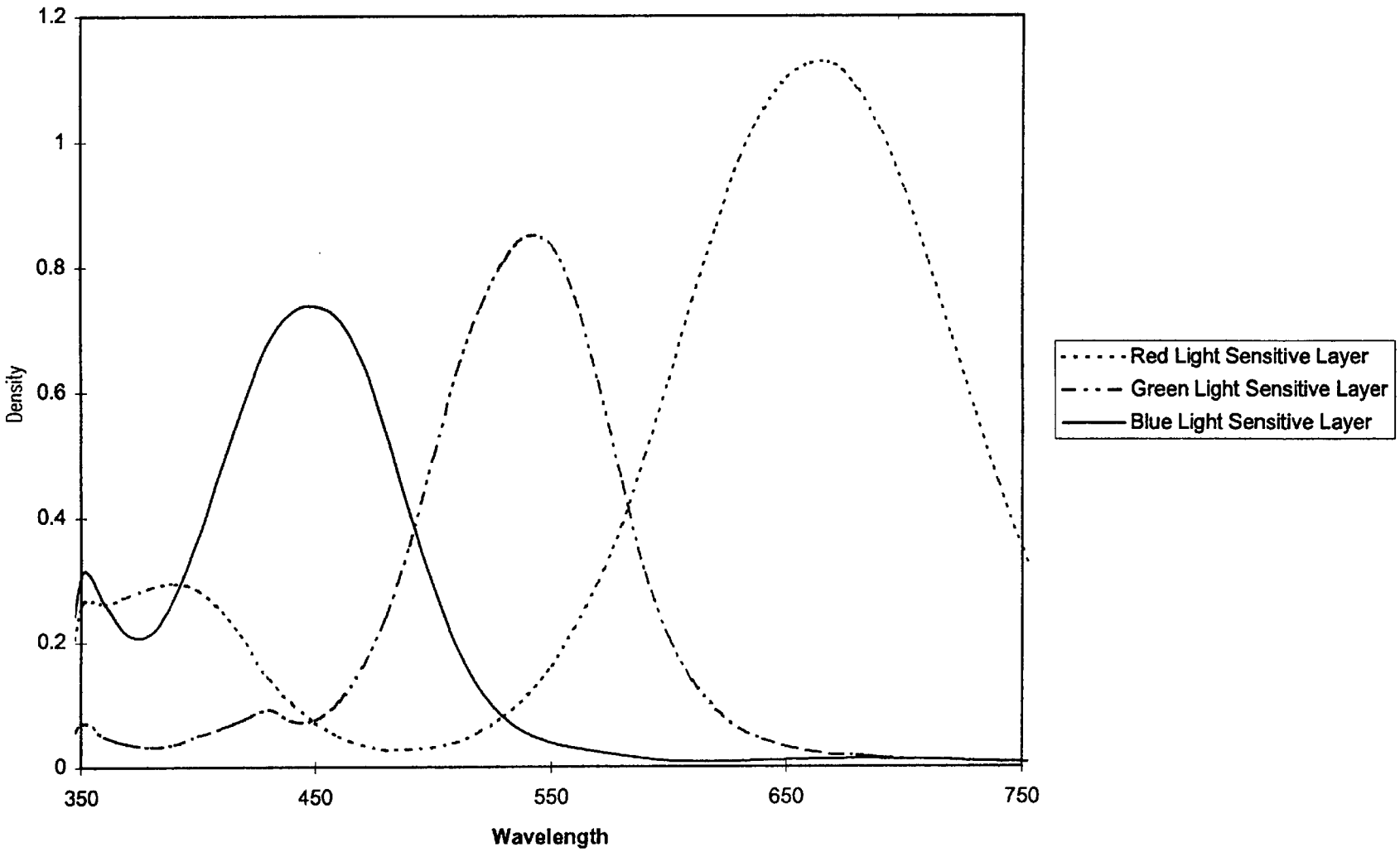
FIG. 1 illustrates the spectral dye densities of dyes formed in the red light sensitive, green light sensitive, and blue light sensitive layers of a conventional motion picture print film (example 101).

The photographic print film elements of the present invention are color elements and contain dye image-forming units sensitive to each of the three primary regions of the spectrum, i.e. blue (about 400 to 500 nm), green (about 500 to 600 nm), and red (about 600 to 760 nm) sensitive image dye-forming units. The multicolor photographic print element of the invention comprises a support bearing a primarily yellow dye image-forming unit comprising at least one blue-sensitive silver halide emulsion layer having associated therewith primary yellow dye-forming coupler and secondary cyan and magenta dye-forming couplers, a primarily cyan dye image-forming unit comprising at least one red-sensitive silver halide emulsion layer having associated therewith an effectively primary amount of cyan dye-forming coupler and effectively secondary amounts of magenta and yellow dye-forming couplers, and a primarily magenta dye image-forming unit comprising at least one green-sensitive silver halide emulsion layer having associated therewith an effectively primary amount of magenta dye-forming coupler and effectively secondary amounts of cyan and yellow dye-forming couplers. Each of the cyan, magenta, and yellow image forming units may be comprised of a single light-sensitive layer, a pack of two light-sensitive layers with one being more light sensitive and the other being less light-sensitive, or a pack of three or more light-sensitive layers of varying light-sensitivity. These layers can be combined in any order depending upon the specific features designed in the photographic element. The element can contain additional layers, such as filter layers, interlayers, overcoat layers, subbing layers, antihalation layers, antistatic layers, and the like.

The primary and secondary dye-forming couplers in each of the dye image-forming units are present in amounts effective to obtain a ratio of Equivalent Neutral Density for the dyes formed from each of the primary dye-forming couplers to each of the secondary dye-forming couplers in each dye-image forming unit of from 20:1 to 3:2, more preferably from 15:1 to 2:1, in the print film upon exposure and processing in the standard ECP-2B motion picture color print process, where such ratios are measured at an exposure level resulting in an Equivalent Neutral Density of 1.0 for the primary image dye color of the respective unit. An Equivalent Neutral Density ratio for each primary dye to each of the secondary dyes in each dye-image forming unit of about 10:1 is particularly useful for approximating the look obtained when processing a conventional print film in a skip-bleach process. Where the primary and secondary dye-forming couplers in each of the dye image-forming units are not present in amounts effective to obtain an Equivalent Neutral Density ratio for the dyes formed from each of the primary dye-forming couplers to each of the secondary dye-forming couplers in each dye-image forming unit of less than 20:1, the desaturation effect has little visual impact. Where such couplers are present in amounts which result in Equivalent Neutral Density ratios of less than 3:2, the image visually approaches that of a black and white image, rather than a desaturated color image in accordance with the invention.

Dye image forming coupler blending in accordance with the invention produces colored-coupler silver halide photographic print elements which enable desaturated non-neutral colors which may be used with conventional printer set-ups and standard processing steps. Elements in accordance with the invention may be designed to provide conventional sensitometric curve properties (e.g., maximum density levels of up to about 3.8), or higher upper scale contrast sensitometric curve properties (e.g., to provide maximum density levels of greater than 3.8 as described in copending U.S. application Ser. No. 08/931,010 referenced above). In constructing films according to the invention, the required parameters can be achieved by various techniques, examples of which are described below. For example, the desaturated color position exhibited in the films according to the invention may be accomplished by any combination of formulation changes such as mixing in secondary image dye forming couplers in the primary image dye forming coupler dispersion or replacing the primary dye forming coupler with a combination of three or more dye forming couplers in such a ratio to produce the desired color position. If desired, the coupler blending techniques described herein may be used in combination with cross-sensitization techniques to obtain desaturated color images as described in copending, commonly assigned, concurrently filed U.S. Ser. No. 09/219,697 (Kodak Docket 78808AJA), the disclosure of which is incorporated by reference herein. The laydowns of silver or image coupler, blend ratio changes of high to low speed emulsions, decreased laydown of image modifying chemistry such as DIR or DIAR coupler, and blend ratio changes of more-active or less-active image couplers can be modified as known in the art to change the neutral tone scale of the film while maintaining the desired color position to be achieved.

In order to maintain consistent color balance throughout the tone scale, couplers for blending should be selected to effectively achieve balanced reactivities in association with the respective dye-forming unit silver halide emulsions and intended photographic processing solutions to desaturate the color reproduction of the resulting images in a neutral manner. For motion picture print films in accordance with the invention, the couplers may be selected to obtain effectively balanced reactivities as taught in U.S. Pat. No. 5,491,053 referenced above, the disclosure of which is hereby incorporated by reference. The relative amounts of primary and secondary dye image-forming couplers required to obtain a desired color position in accordance with the invention will of course depend upon actual couplers used. However, as the object in U.S. Pat. No. 5,491,053 is to obtain a resulting black and white image (i.e., overall neutral), the relative amounts of primary and secondary couplers will generally be effectively different to obtain desaturated color positions in accordance with the instant invention as opposed to a black and white image in accordance with U.S. Pat. No. 5,491,053.

Couplers that may be used in the elements of the invention can be defined as being 4-equivalent or 2-equivalent depending on the number of atoms of $Ag^+$ required to form one molecule of dye. A 4-equivalent coupler can generally be converted into a 2-equivalent coupler by replacing a hydrogen at the coupling site with a different coupling-off group. Coupling-off groups are well known in the art. Such groups can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169; 3,227,551; 3,432,521; 3,476,563; 3,617,291; 3,880,661; 4,052,212 and 4,134,766; and in U.K. Patents and published Application Nos. 1,466,728; 1,531,927; 1,533,039; 2,006,755A and 2,017,704A, the disclosures of which are incorporated herein by reference.

Image dye-forming couplers may be included in elements of the invention such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,096; 570,006; and 574,948.

Couplers that form magenta dyes upon reaction with oxidized color developing agent which can be incorporated in elements of the invention are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent Applications 176,804; 177,765; U.S. Pat. Nos. 4,659,652; 5,066,575; and 5,250,400.

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

To control the migration of various components coated in a photographic layer, including couplers, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to a polymeric backbone.

It may be useful to use a combination of couplers any of which may contain known ballasts or coupling-off groups such as those described in U.S. Pat. Nos. 4,301,235; 4,853,319 and 4,351,897.

In the following discussion of suitable materials for use in elements in conjunction with the invention, reference will be made to *Research Disclosure,* September 1994, Item 36544, available as described above, which will be identified hereafter by the term "*Research Disclosure.*" The contents of the *Research Disclosure,* including the patents and publications referenced therein, are incorporated herein by reference, and the Sections hereafter referred to are Sections of the *Research Disclosure,* Item 36544.

The silver halide emulsions employed in the elements of this invention will be negative-working emulsions. Suitable silver halide emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing conditions can be found in Sections XI–XX.

It is also contemplated that the materials and processes described in an article titled "Typical and Preferred Color Paper, Color Negative, and Color Reversal Photographic Elements and Processing," published in *Research Disclosure,* February 1995, Item 37038 also may be advantageously used with elements of the invention. It is further specifically contemplated that the print elements of the invention may comprise antihalation and antistatic layers and associated compositions as set forth in U.S. Pat. Nos. 5,650,265, 5,679,505, and 5,723,272, the disclosures of which are incorporated by reference herein.

Photographic light-sensitive print elements of the invention may utilize silver halide emulsion image forming layers wherein chloride, bromide and/or iodide are present alone or as mixtures or combinations of at least two halides. The combinations significantly influence the performance characteristics of the silver halide emulsion. Print elements are typically distinguished from camera negative elements by the use of high chloride (e.g., greater than 50 mole % chloride) silver halide emulsions containing no or only a minor amount of bromide (typically 10 to 40 mole %), which are also typically substantially free of iodide. As explained in Atwell, U.S. Pat. No. 4,269,927, silver halide with a high chloride content possesses a number of highly advantageous characteristics. For example, high chloride silver halides are more soluble than high bromide silver halide, thereby permitting development to be achieved in shorter times. Furthermore, the release of chloride into the developing solution has less restraining action on development compared to bromide and iodide and this allows developing solutions to be utilized in a manner that reduces the amount of waste developing solution. Since print films are intended to be exposed by a controlled light source, the imaging speed gain which would be associated with high bromide emulsions and/or iodide incorporation offers little benefit for such print films.

Photographic print elements are also distinguished from camera negative elements in that print elements typically comprise only fine silver halide emulsions comprising grains having an average equivalent circular diameter (ECD) of less than about 1 micron, where the ECD of a grain is the diameter of a circle having the area equal to the projected area of a grain. The ECDs of silver halide emulsion grains are usually less than 0.60 micron in red and green sensitized layers and less than 0.90 micron in blue sensitized layers of a color photographic print element. Such fine grain emulsions used in print elements generally have an aspect ratio of less than 1.3, where the aspect ratio is the ratio of a grain's ECD to its thickness, although higher aspect ratio grains may also be used. Such grains may take any regular shapes, such as cubic, octahedral or cubo-octahedral (i.e., tetradecahedral) grains, or the grains can take other shapes attributable to ripening, twinning, screw dislocations, etc. Typically, print element emulsions grains are bounded primarily by {100} crystal faces, since { 100} grain faces are exceptionally stable. Specific examples of high chloride emulsions used for preparing photographic prints are provided in U.S. Pat. Nos. 4,865,962; 5,252,454; and 5,252,456, the disclosures of which are here incorporated by reference.

Photographic print films which comprise relatively small grain, high chloride emulsions (e.g., emulsions having average grain size equivalent circular diameters of less than about 1 micron and halide contents of greater than 50 mole % chloride) as discussed above in order to optimize print image quality and enable rapid processing typically result in relatively low speed photographic elements in comparison to camera negative origination films. Low speed is compensated for by the use of relatively high intensity print lamps or lasers for exposing such print elements. For comparison purposes, it is noted that motion picture color print films, e.g., when rated using the same international standards criteria used for rating camera negative films, would typically have an ISO speed rating of less than 10, which is several stops slower than the slowest camera negative films in current use.

If desired, the photographic elements of the invention can be used in conjunction with an applied magnetic layer as described in *Research Disclosure,* November 1992, Item 34390 published by Kenneth Mason Publications, Ltd., Dudley House, 12 North Street, Emsworth, Hampshire P010 7DQ, ENGLAND.

Photographic elements of the present invention are motion picture print film elements. Such elements typically have a width of up to 100 millimeters (or only up to 70 or 50 millimeters), and a length of at least 30 meters (or optionally at least 100 or 200 meters). In motion picture printing, there are usually three records to record in the image area frame region of a print film, i.e., red, green and blue. The original record to be reproduced is preferably an image composed of sub-records having radiation patterns in different regions of the spectrum. Typically it will be a multicolor record composed of sub-records formed from cyan, magenta and yellow dyes. The principles by which such materials form a color image are described in James, The Theory of the Photographic Process, Chapter 12, Principles and Chemistry of Color Photography, pp 335–372, 1977, Macmillan Publishing Co. New York. Materials in which such images are formed can be exposed to an original scene in a camera, or can be duplicates formed from such camera origination materials, e.g., records formed in color negative intermediate films such as those identified by the tradenames Eastman Color Intermediate Films 2244, 5244 and 7244. Alternatively, the original record may be in the form of electronic image data, which may be used to control a printer apparatus, such as a laser printer, for selective imagewise exposure of a print film in accordance with the invention.

In accordance with the invention, print films may be exposed under normal printing conditions which may be indicated with the film or other manufacturer recommendations, and processed according to standard processing conditions indicated with the film or its packaging. This is advantageous in that the film user need not experiment with various development or print exposing conditions in order to obtain a desired color position. The film of the present invention is preferably simply printed and processed according to standard procedures, and the advantages of the film are obtained. Alternative processing techniques, however, can also be used with films according to the invention if desired.

By "indicated" in relation to the film printing and processing conditions, means that some designation is provided on the film or its packaging or associated with one or the other, which allows the user to ascertain the manufacturer's recommended printing and/or film processing conditions. Such a designation can be an actual statement of the recommended printing or processing conditions or reference to a well-known standard method (for example, the Kodak ECP-2B process for motion picture print films). Alternatively, such a designation can be a film identification designation (such as a number or film name) which allows a user to match the film with the manufacturer's recommended printing or processing conditions (such as from a catalogue, brochure or other source).

The following examples illustrate preparation of photographic elements of the present invention, and their beneficial characteristics.

EXAMPLE 1

Multilayer element 101 in accordance with conventional motion picture print elements having no image dye-forming coupler mixing is prepared by coating the following layers on a gelatin subbed polyethylene terephthalate support with rem-jet carbon black containing backing layer. Elements 102, 103 and 104 in accordance with the invention are prepared by substitution of a mixture of magenta dye forming coupler (M-2), cyan dye forming coupler (C-1) and yellow dye forming coupler (Y-1) in place of magenta dye forming coupler (M-1) in the green sensitized layer, addition of magenta dye forming coupler (M-2) and yellow dye forming coupler (Y-1) to the red sensitized layer, and addition of magenta dye forming coupler (M-2) and cyan dye forming coupler (C-1) to the blue sensitized layer. The couplers are selected in accordance with U.S. Pat. No. 5,491,053 to provide matched reactivities, and laydowns are selected to provide ratios of Equivalent Neutral Density for the dyes formed from each of the primary dye-forming couplers to each of the secondary dye-forming couplers in each dye-image forming unit upon exposure and processing in the standard ECP-2B motion picture color print process of 10:1 for Element 102, 3:1 for Element 103, and 2:1 for Element 104. All units unless otherwise specified arc in $mg/m^2$:

| | Element 101 | Element 102 | Element 103 | Element 104 |
|---|---|---|---|---|
| Sixth Layer: Protective Overcoat Layer | | | | |
| Poly(dimethyl siloxane) 200-CS | 26 | 26 | 26 | 26 |
| Poly(methyl methacrylate) beads | 5.3 | 5.3 | 5.3 | 5.3 |
| Gelatin | 976 | 976 | 976 | 976 |

-continued

| | Element 101 | Element 102 | Element 103 | Element 104 |
|---|---|---|---|---|
| Spreading aids | | | | |
| Fifth Layer: Green Sensitized Layer | | | | |
| AgClBr cubic grain emulsion, 25% Br, 0.15 micron, spectrally sensitized with green dye cpd 1, 0.5273 mmole/Ag mole, and supersensitizer cpd 2, 1.1212 mmole/Ag mole, | 236 | 236 | 236 | 236 |
| AgClBr cubic grain emulsion, 25% Br, 0.15 micron, spectrally sensitized with green dye cpd 1, 0.5273 mmole/Ag mole, and supersensitizer cpd 2, 1.1770 mmole/Ag mole, | 174 | 174 | 174 | 174 |
| AgClBr cubic grain emulsion, 25% Br, 0.24 micron, spectrally sensitized with green dye cpd 1, 0.4785 mmole/Ag mole, and supersensitizer cpd 2, 1.3902 mmole/Ag mole, | 25 | 25 | 25 | 25 |
| Magenta dye forming coupler M-1 | 700 | 0 | 0 | 0 |
| Magenta dye forming coupler M-2 | 0 | 579.6 | 414 | 351.9 |
| Cyan dye forming coupler C-1 | 0 | 90.4 | 215.3 | 274.5 |
| Yellow dye forming coupler Y-1 | 0 | 148.5 | 353.7 | 451.0 |
| Oxidized developer scavenger cpd 3 | 56 | 56 | 56 | 56 |
| Soluble green filter dye 1 | 40 | 40 | 40 | 40 |
| Soluble green filter dye 2 | 2.9 | 2.9 | 2.9 | 2.9 |
| Gelatin | 1965 | 1965 | 1965 | 1965 |
| Fourth Layer: Interlayer | | | | |
| Oxidized developer scavenger cpd 3 | 79 | 79 | 79 | 79 |
| Gelatin | 610 | 610 | 610 | 610 |
| Spreading aids | | | | |
| Third Layer: Red Sensitized Layer | | | | |
| AgClBr cubic grain emulsion, 25% Br, 0.15 micron, spectrally sensitized with red dye cpd 4, 0.1808 mmole/Ag mole, supersensitizer cpd 2, 0.6327 mmole/Ag mole | 415 | 415 | 415 | 415 |
| AgClBr cubic grain emulsion, 25% Br, 0.24 micron, spectrally sensitized with red dye cpd 4, 0.1356 mmole/Ag mole, supersensitizer cpd 2, 0.7444 mmole/Ag mole | 24 | 24 | 24 | 24 |
| Cyan dye forming coupler C-1 | 958 | 904 | 645.8 | 548.9 |
| Magenta dye forming coupler M-2 | 0 | 58 | 138.0 | 176.0 |
| Yellow dye forming coupler Y-1 | 0 | 148.5 | 353.7 | 451.0 |
| Oxidized developer scavenger cpd 3 | 12 | 12 | 12 | 12 |
| Soluble red filter dye 3 | 105 | 105 | 105 | 105 |
| Gelatin | 3580 | 3580 | 3580 | 3580 |
| Second Layer: Interlayer | | | | |
| Oxidized developer scavenger cpd 3 | 79 | 79 | 79 | 79 |
| Gelatin | 610 | 610 | 610 | 610 |
| Spreading aids | | | | |
| First Layer: Blue Sensitized Layer | | | | |
| AgCl cubic grain emulsion, 0.58 micron, spectrally sensitized with blue dye cpd 7, 0.3336 mmole/Ag mole | 676 | 676 | 676 | 676 |
| AgCl cubic grain emulsion, 0.76 micron, spectrally sensitized with blue dye cpd 7, 0.2669 mmole/Ag mole | 225 | 225 | 225 | 225 |
| Yellow dye forming coupler (Y-1) | 1884 | 1485.4 | 1061 | 901.9 |
| Cyan dye forming coupler C-1 | 0 | 90.4 | 215.3 | 274.5 |
| Magenta dye forming coupler M-2 | 0 | 58.0 | 138.0 | 176.0 |
| Yellow dye cpd 8 | 22 | 22 | 22 | 22 |
| Soluble blue filter dye 4 | 16 | 16 | 16 | 16 |
| Sequestrant cpd 9 | 323 | 323 | 323 | 323 |
| Sequestrant cpd 10 | 36 | 36 | 36 | 36 |
| Gelatin | 3546 | 3546 | 3546 | 3546 |

Support:
Transparent polyethylene terephthalate support with rem-jet carbon black pigmented, non-gelatin layer on the back of the film base which provides antihalation and antistatic properties Each element also contains bis-vinylsulfonylmethane (BVSM) as a gelatin hardener. Couplers are dispersed with high-boiling coupler solvents and/or auxiliary solvents in accordance with conventional practice in the art.

The above film samples 101, 102, 103 and 104 are exposed through a 0–3 density 21-step tablet on a Kodak 1B sensitometer with a 3200 K light source, and processed according to the standard Kodak ECP-2B Color Print Development Process as described in the Kodak H-24 Manual, "*Manual for Processing Eastman Motion Picture Films*", Eastman Kodak Company, Rochester, N.Y., the disclosure of which is incorporated by reference herein, with the exception that those steps specific to sound track development are omitted. Exposures are adjusted so that upon standard processing a middle (e.g., 11th) step achieves Red, Green, Blue Equivalent Neutral Density of 1.0, 1.0, 1.0. The process consists of a prebath (10"), water rinse (20"), color developer (3'), stop bath (40"), first wash (40"), first fix (40"), second wash (40"), bleach (1'), third wash (40"), second fix (40"), fourth wash (1'), final rinse (10"), and then drying with hot air.

| | |
|---|---|
| The ECP-2B Prebath consists of: | |
| Water | 800 mL |
| Borax (decahydrate) | 20.0 g |
| Sodium sulfate (anhydrous) | 100.0 g |
| Sodium hydroxide | 1.0 g |
| Water to make 1 liter | |
| pH @ 26.7° C. is 9.25 +/−0.10 | |
| The ECP-2B Color Developer consists of: | |
| Water | 900 mL |
| Kodak Anti-Calcium, No. 4 (40% solution of a pentasodium salt of nitrilo-tri(methylene phosphonic acid) | 1.00 mL |
| Sodium sulfite (anhydrous) | 4.35 g |
| Sodium bromide (anhydrous) | 1.72 g |
| Sodium carbonate (anhydrous) | 17.1 g |
| Kodak Color Developing Agent, CD-2 | 2.95 g |
| Sulfuric acid (7.0N) | 0.62 mL |
| Water to make 1 liter | |
| pH @ 26.7° C. is 10.53 +/−0.05 | |
| The ECP-2B Stop Bath consists of: | |
| Water | 900 mL |
| Sulfuric acid (7.0N) | 50 mL |
| Water to make 1 liter | |
| pH @ 26.7° C. is 0.90 | |
| The ECP-2B Fixer consists of: | |
| Water | 800 mL |
| Ammonium thiosulfate (58.0% solution) | 100.0 mL |
| Sodium bisulfate (anhydrous) | 13.0 g |
| Water to make 1 liter | |
| pH @ 26.7° C. is 5.00 +/−0.15 | |
| The ECP-2B Ferricyanide Bleach consists of: | |
| Water | 900 mL |
| Potassium ferricyanide | 30.0 g |
| Sodium bromide (anhydrous) | 17.0 g |
| Water to make 1 liter | |
| pH @ 26.7° C. is 6.50 +/−0.05 | |
| The Final Rinse solution consists of: | |
| Water | 900 mL |
| Kodak Photo-Flo 200 (TM) Solution | 3.0 mL |
| Water to make 1 liter | |

Processing of the exposed elements is done with the color developing solution adjusted to 36.7° C. The stopping, fixing, bleaching, washing, and final rinsing solution temperatures are adjusted to 26.7° C.

The films are then read for Status A densitometry, and converted to Equivalent Neutral Densitometry using the method as described in the article "Procedures for Equivalent-Neutral-Density (END) Calibration of Color Densitometers Using a Digital Computer", by Albert J. Sant, in the Photographic Science and Engineering, Vol. 14, Number 5, September–October 1970, pg. 356–362.

The spectral dye densities vs. Wavelength of the red light sensitive, green light sensitive, and blue light sensitive layers of Example 101 are shown in FIG. 1. The plot represents a red, green, and blue Equivalent Neutral Densities of 1.0, 1.0, 1.0 respectively. Notice that there is little unwanted absorption of the dyes in the other spectral regions, corresponding to Equivalent Neutral Density ratios of primary dye to each secondary dye in each of the dye image-forming units of much greater than 20:1.

Figure 2:
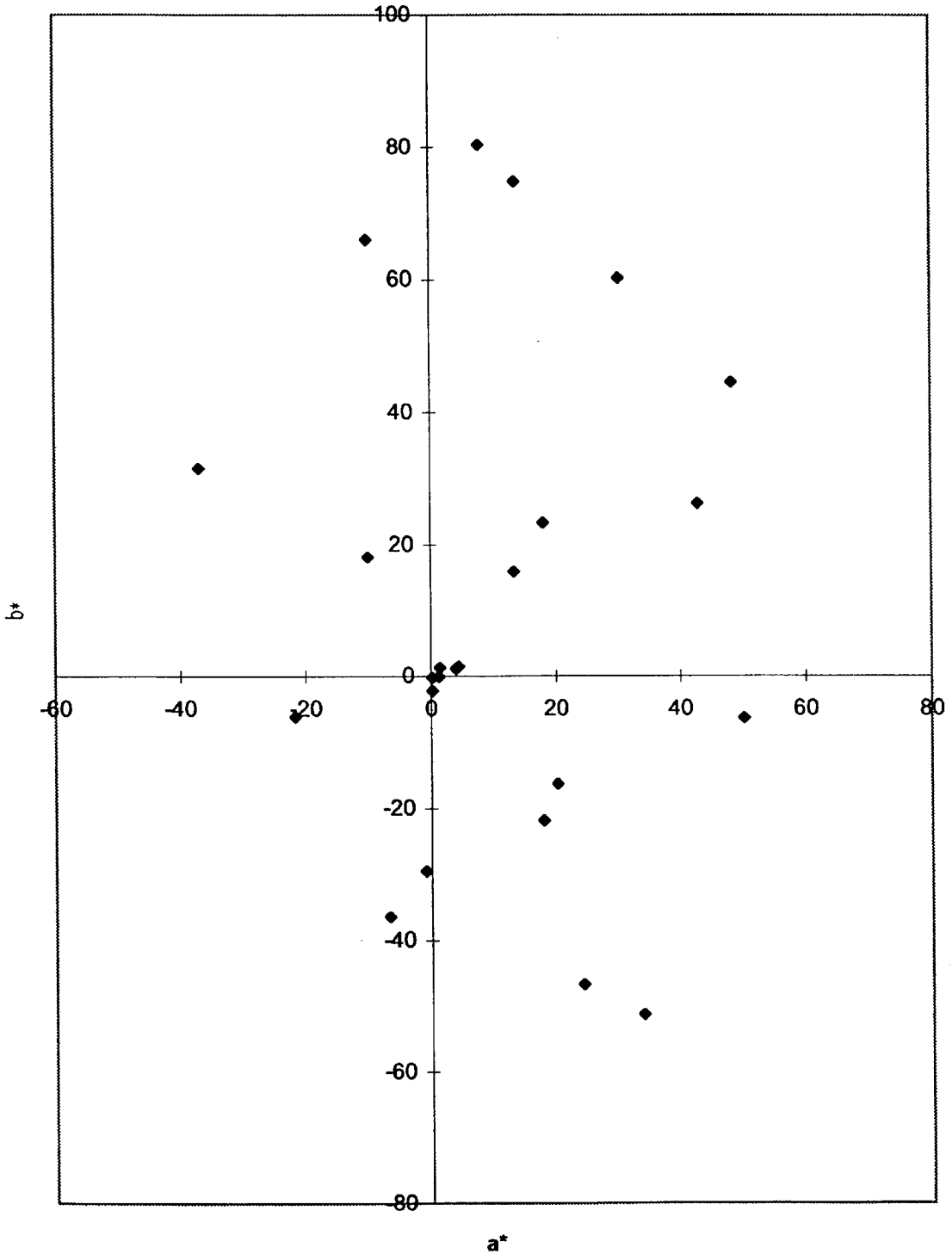
FIG. 2 illustrates the CIELAB plot of a* vs. b* colorimetric color reproduction of a MacBeth ColorChecker printed onto a conventional motion picture print film (example 101) and processed through the normal ECP-2B process.

FIG. 2 illustrates the CIELAB plot of a* vs. b* which represents the colorimetric color reproduction of a MacBeth ColorChecker Color Rendition Chart originally photographed on KODAK VISION 500T Color Negative Film 5279™ at a normal exposure which is printed onto Example 101 and processed through the normal ECP-2B process. The MacBeth ColorChecker Color Rendition Chart is described, e.g., in Leslie Stroebel et al., Photographic Materials & Processes (Boston, 1986), pp 541–545, which is incorporated herein by reference. The correct or standard exposure for negative film can be determined in accordance with the recommendations of the film manufacturer. CIELAB is a system of color coordinates in which colors can be numerically specified and positioned on a CIE diagram, or map. (Ref: Photographic Materials & Processes, pp 492–499). On the color map, locations may be specified by the metric hue angle (measured counter-clockwise from the positive a* axis) and metric chroma (distance from the neutral center point). (Ref: Fred W. Billmeyer and Max Saltzman, Principles of Color Technology 2Ed, (New York, 1981) pp 62–65). A print can be made from the negative using the conventional negative/positive processing. Then, using standard colorimetric measurements and calculations, the CIELAB a* and b* values of the print can be determined for each reproduction and plotted on a CIELAB a* vs b* diagram. The measured metric hue angles and metric chroma values can then be determined in accordance with Principles of Color Technology.

Figure 3:
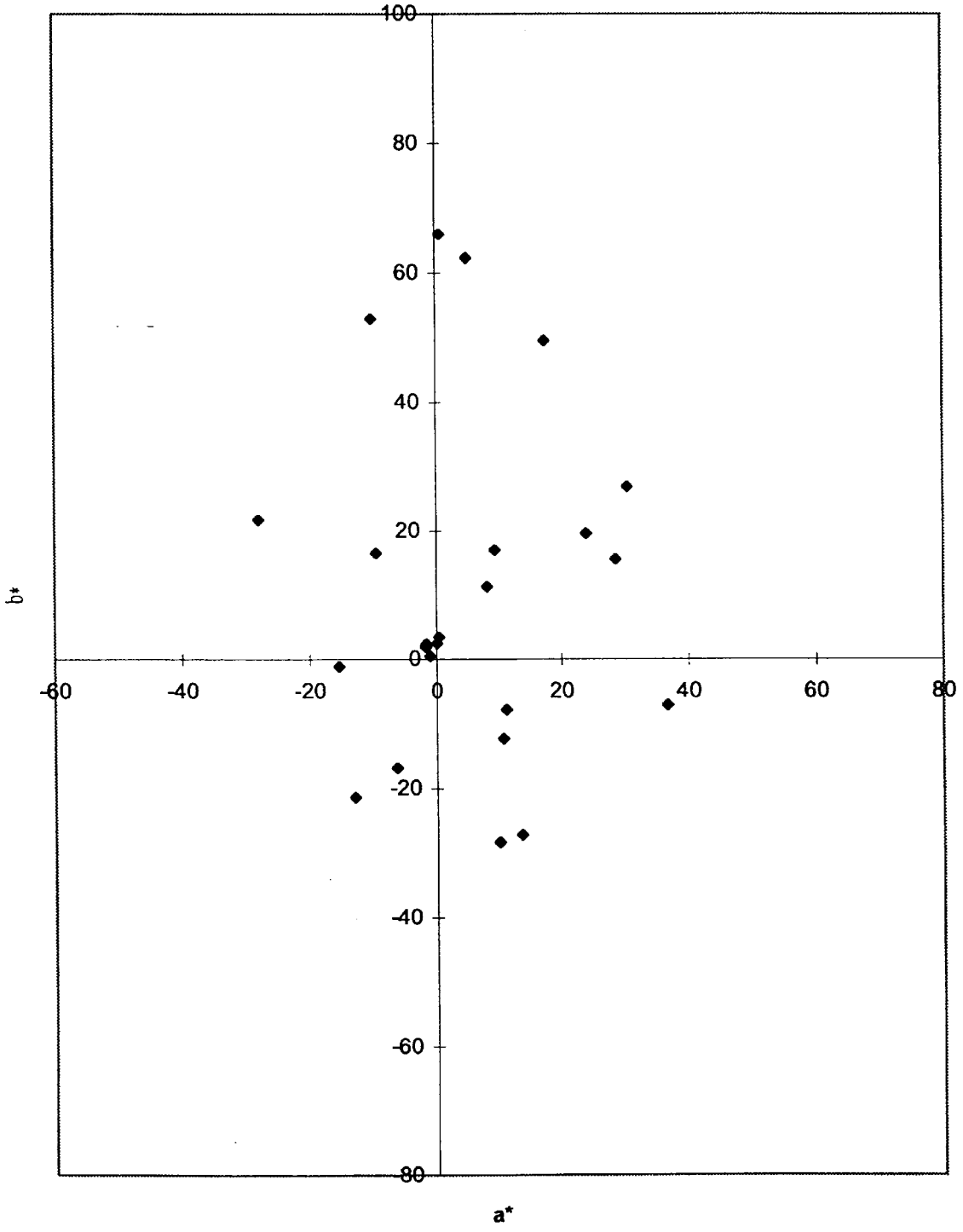
FIG. 3 illustrates the CIELAB plot of a* vs. b* colorimetric color reproduction of a MacBeth ColorChecker printed onto a conventional motion picture print film (example 101) and processed through the ECP-2B process bypassing the bleach step.

FIG. 3 illustrates the CIELAB plot of a* vs. b* which represents the colorimetric color reproduction of a MacBeth ColorChecker Color Rendition Chart originally photographed on KODAK VISION 500T Color Negative Film 5279™ at a normal exposure which is printed onto Example 101 and processed through the ECP-2B process bypassing the bleach step (i.e., the "skip-bleach" process). In comparison to FIG. 2, the non-neutral patches of the MacBeth ColorChecker have moved toward the origin of the plot which represents a desaturation in color reproduction.

Figure 4:
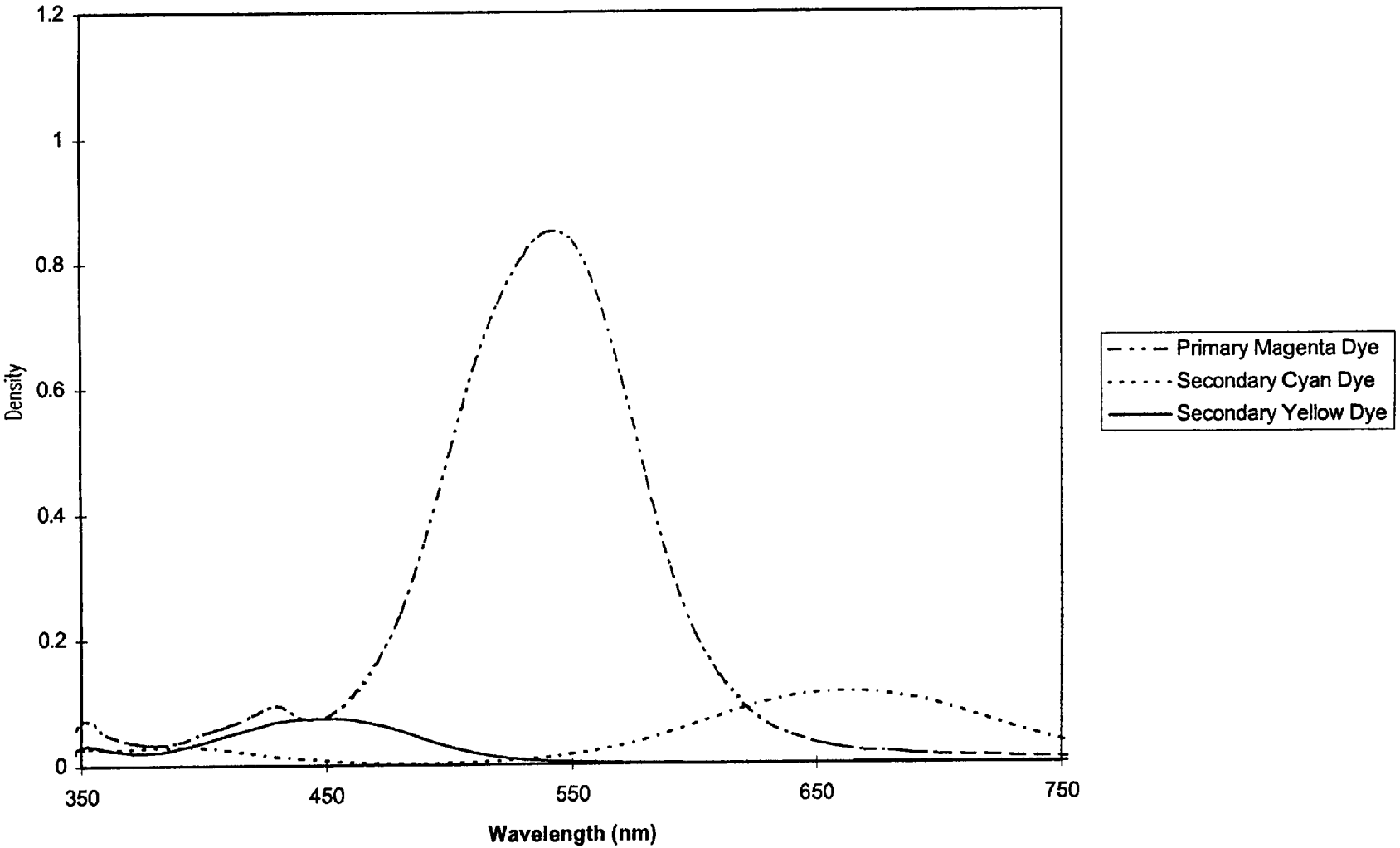
FIG. 4 illustrates the spectral dye densities of dyes formed in the green light sensitive layer of a motion picture print film having a primary dye to secondary dye Equivalent Neutral Density ratio of 10:1 in accordance with Example 102.
Figure 5:
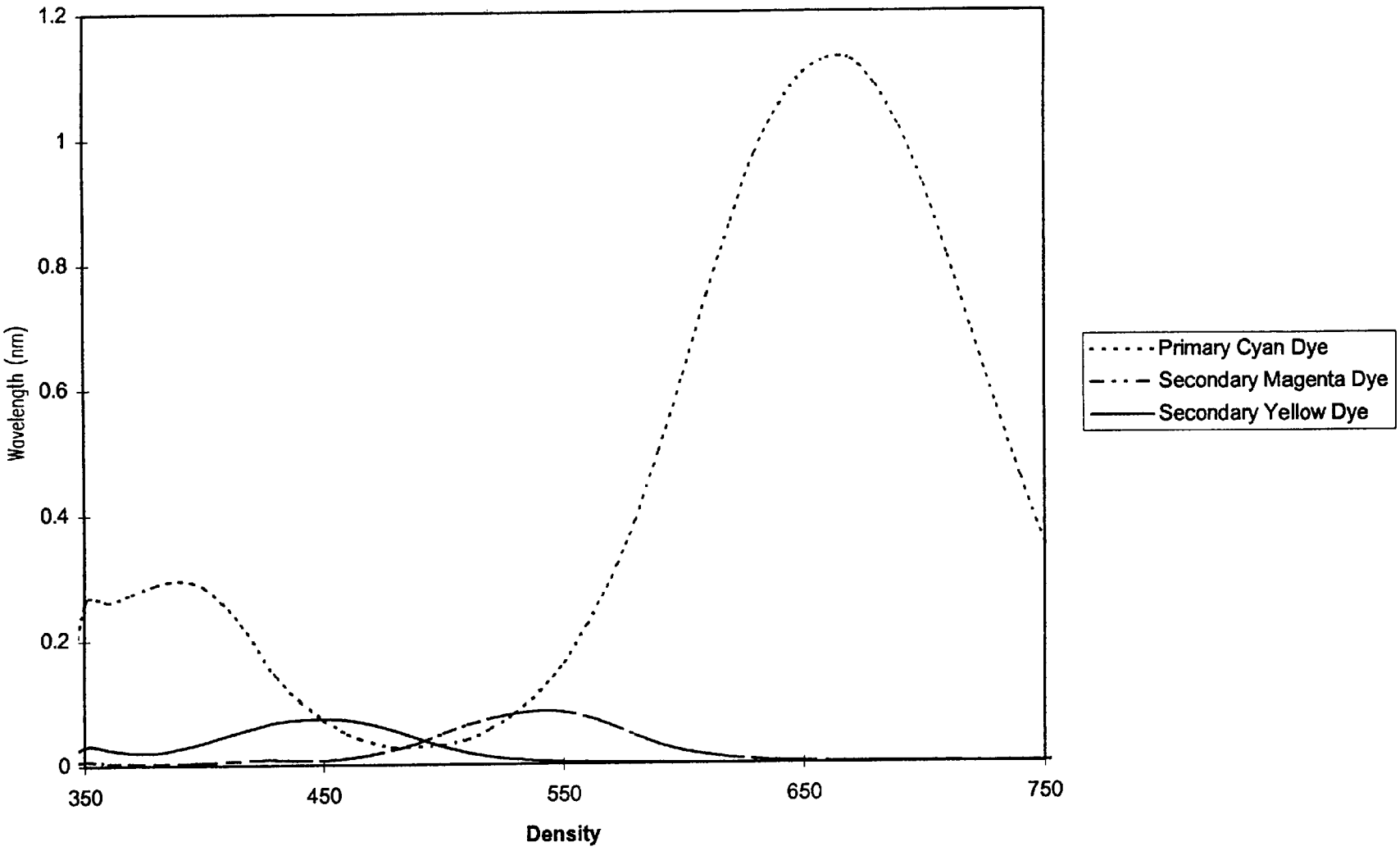
FIG. 5 illustrates the spectral dye densities of dyes formed in the red light sensitive layer of a motion picture print film having a primary dye to secondary dye Equivalent Neutral Density ratio of 10:1 in accordance with Example 102.
Figure 6:
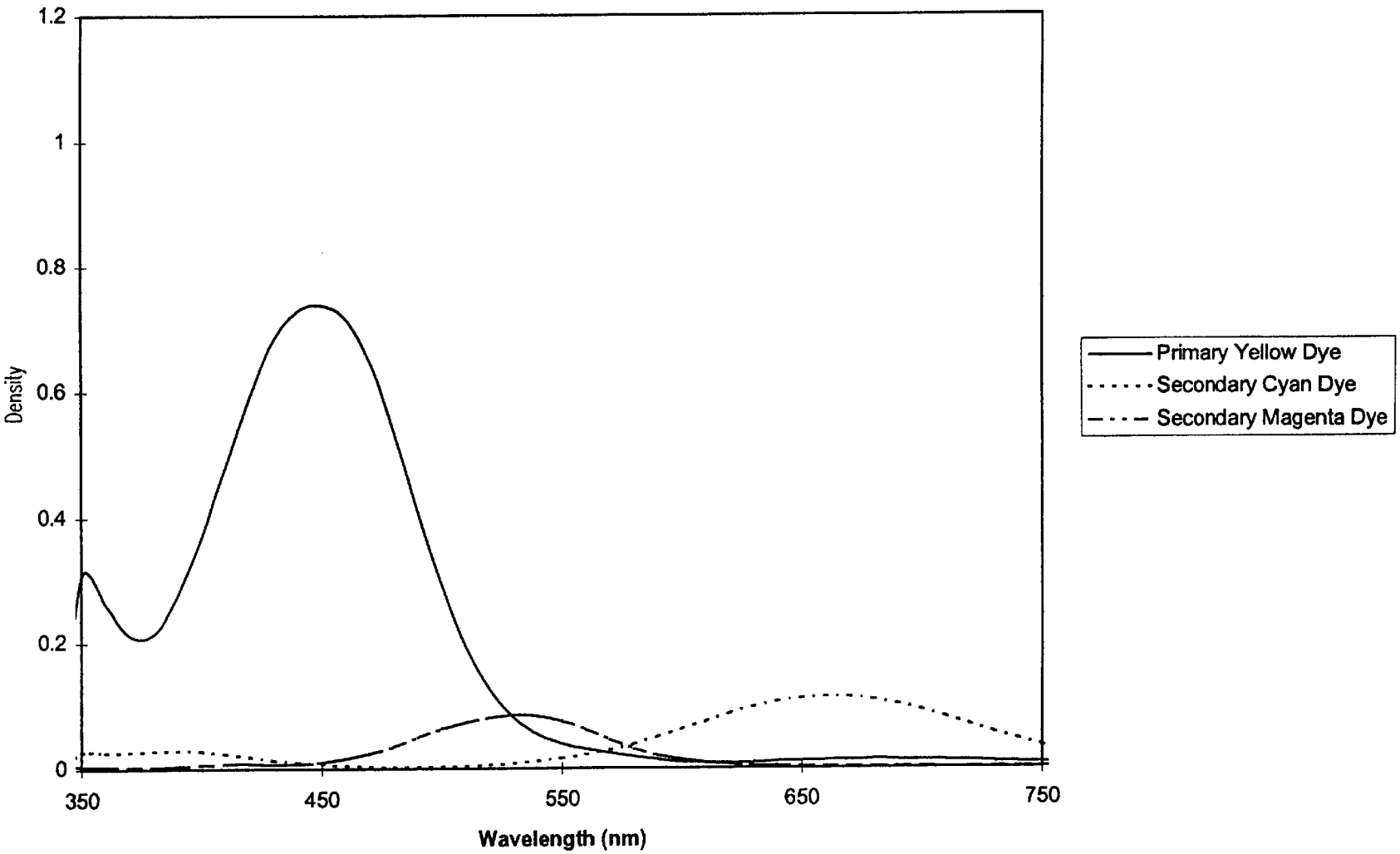
FIG. 6 illustrates the spectral dye densities of dyes formed in the blue light sensitive layer of a motion picture print film having a primary dye to secondary dye Equivalent Neutral Density ratio of 10:1 in accordance with Example 102.
Figure 7:
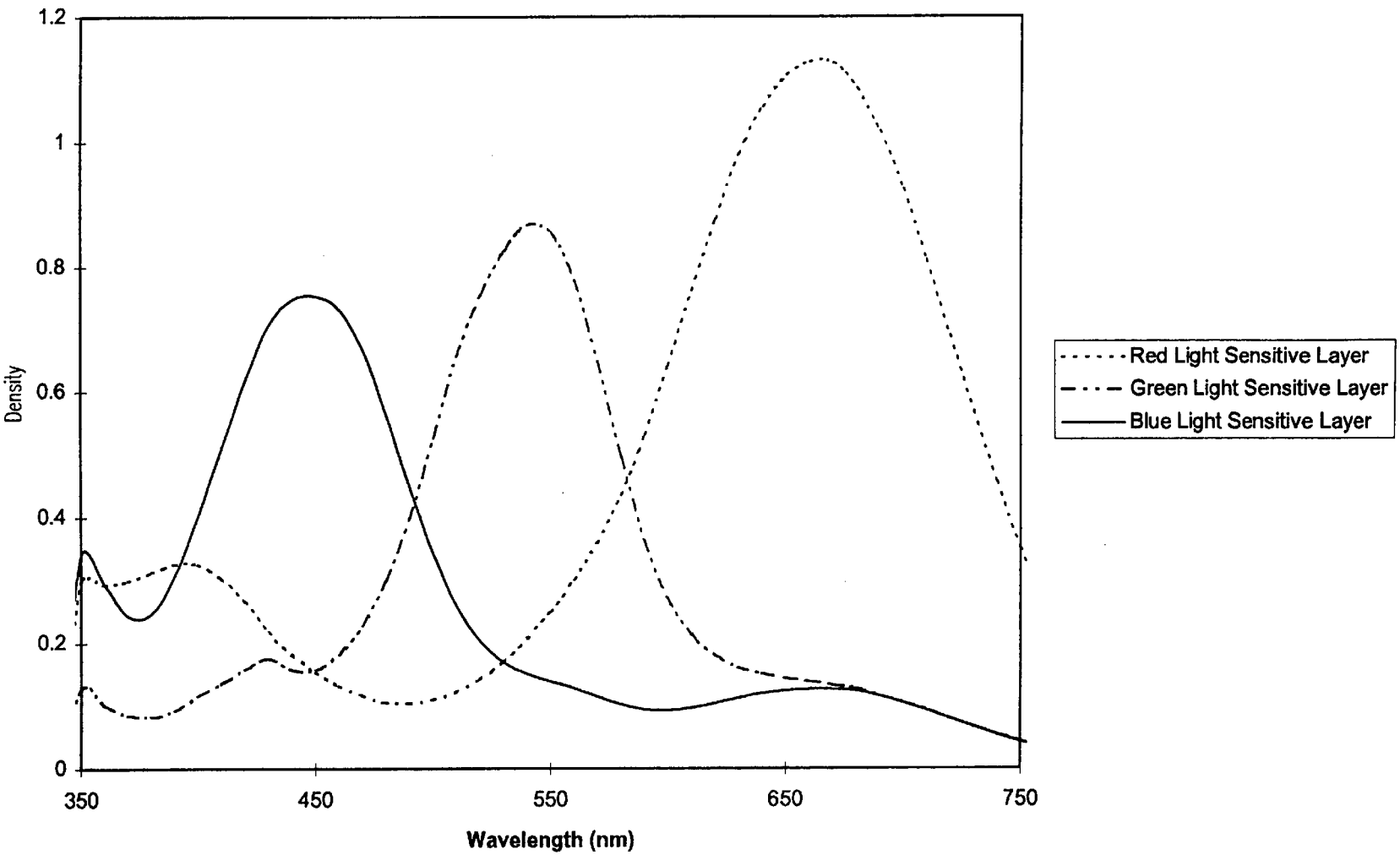
FIG. 7 illustrates the combined spectral dye densities of dyes formed in the green, red and blue light sensitive layers of a motion picture print film having a primary dye to secondary dye Equivalent Neutral Density ratio of 10:1 in accordance with Example 102.

An Equivalent Neutral Density ratio of primary dye to each secondary dye in each of the dye image-forming units of about 10:1, measured at an exposure resulting in an Equivalent Neutral Density of 1.0 for the primary image dye color of the respective unit, is obtained for Element 102. FIG. 4 illustrates the spectral dye densities of dyes formed in the green light sensitive layer, FIG. 5 illustrates the spectral dye densities of dyes formed in the red light sensitive layer, FIG. 6 illustrates the spectral dye densities of dyes formed in the blue light sensitive layer, and FIG. 7 illustrates the combined spectral dye densities of dyes formed in the green, red and blue light sensitive layers of a motion picture print film having a primary dye to secondary dye Equivalent Neutral Density ratio of 10:1 in accordance with Example 102.

Figure 8:
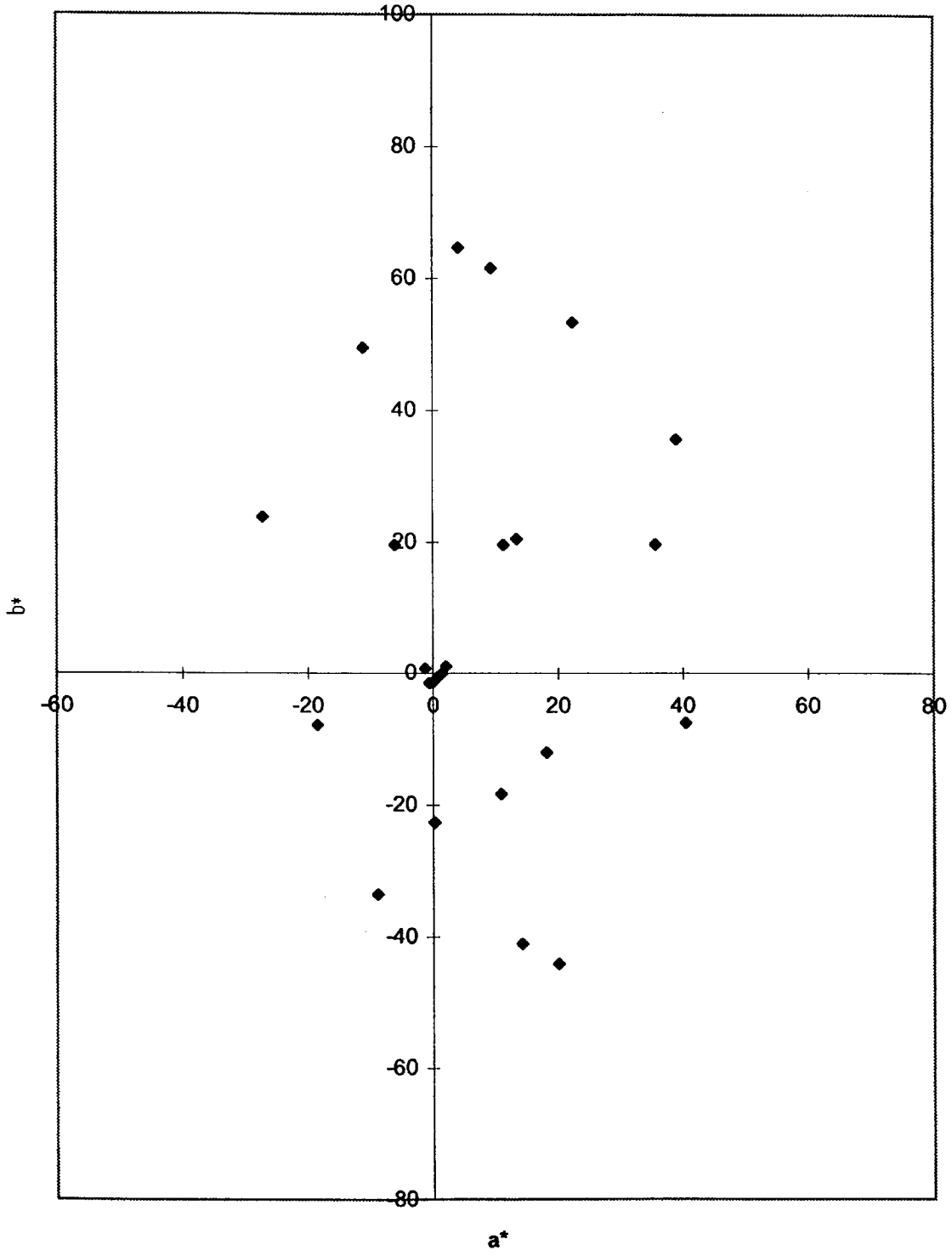
FIG. 8 illustrates the CIELAB plot of a* vs. b* colorimetric color reproduction of a MacBeth ColorChecker printed onto a motion picture print film having a primary dye to secondary dye Equivalent Neutral Density ratio of 10:1 in accordance with Example 102 and processed through the normal ECP-2B process.

FIG. 8 illustrates the CIELAB plot of a* vs. b* colorimetric color reproduction of a MacBeth ColorChecker Color Rendition Chart originally photographed on KODAK VISION 500T Color Negative Film 5279™ at a normal exposure which is printed onto Example 102 and processed through the normal ECP-2B process. In comparison to FIG. 2, the non-neutral patches of the MacBeth ColorChecker have moved toward the origin of the plot which represents a desaturation in color reproduction. The results approximate those obtained by "skip-bleach" processing of Element 101 as shown in FIG. 3.

Figure 9:
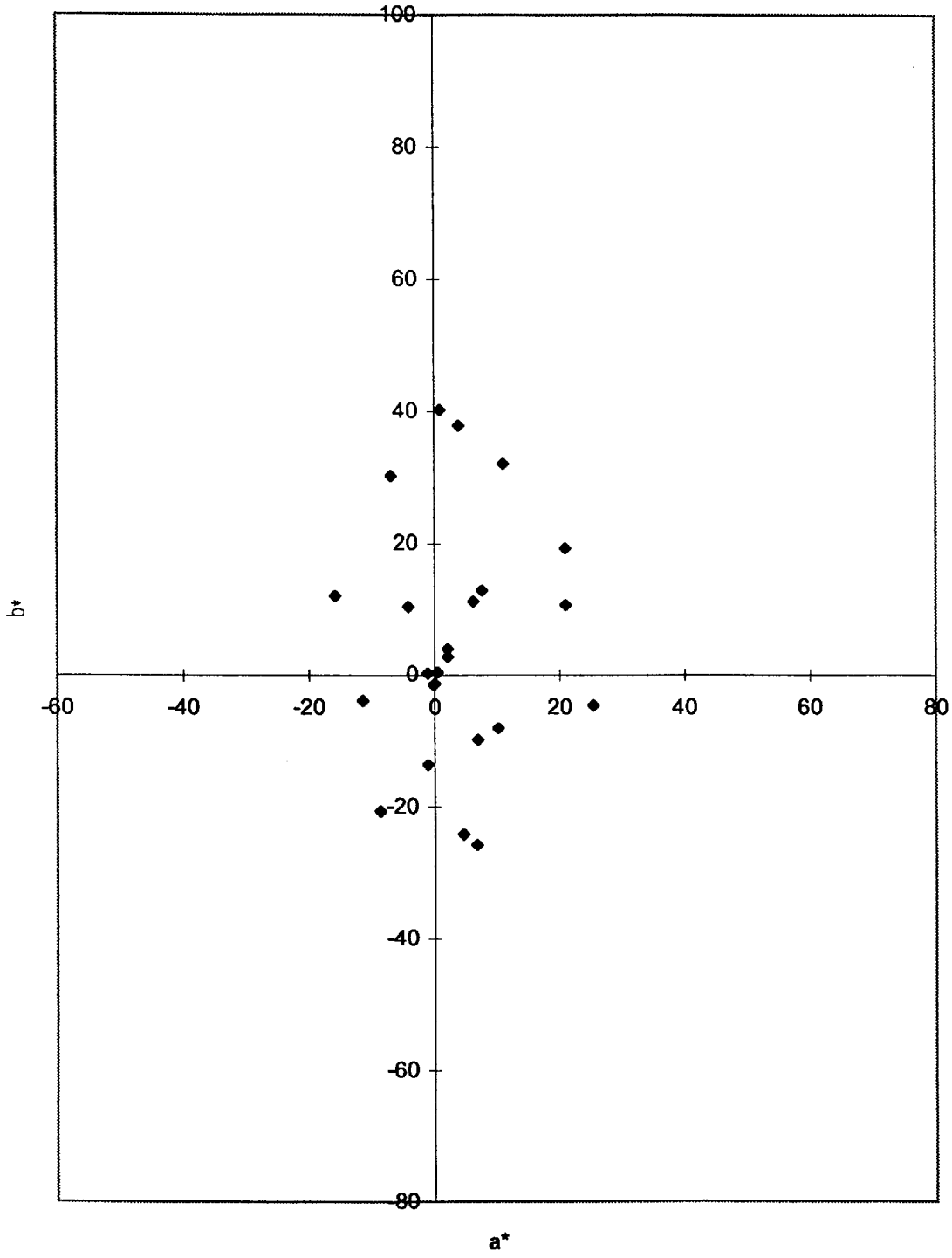
FIG. 9 illustrates the CIELAB plot of a* vs. b* colorimetric color reproduction of a MacBeth ColorChecker printed onto a motion picture print film having a primary dye to secondary dye Equivalent Neutral Density ratio of 3:1 in accordance with Example 103 and processed through the normal ECP-2B process.
Figure 10:
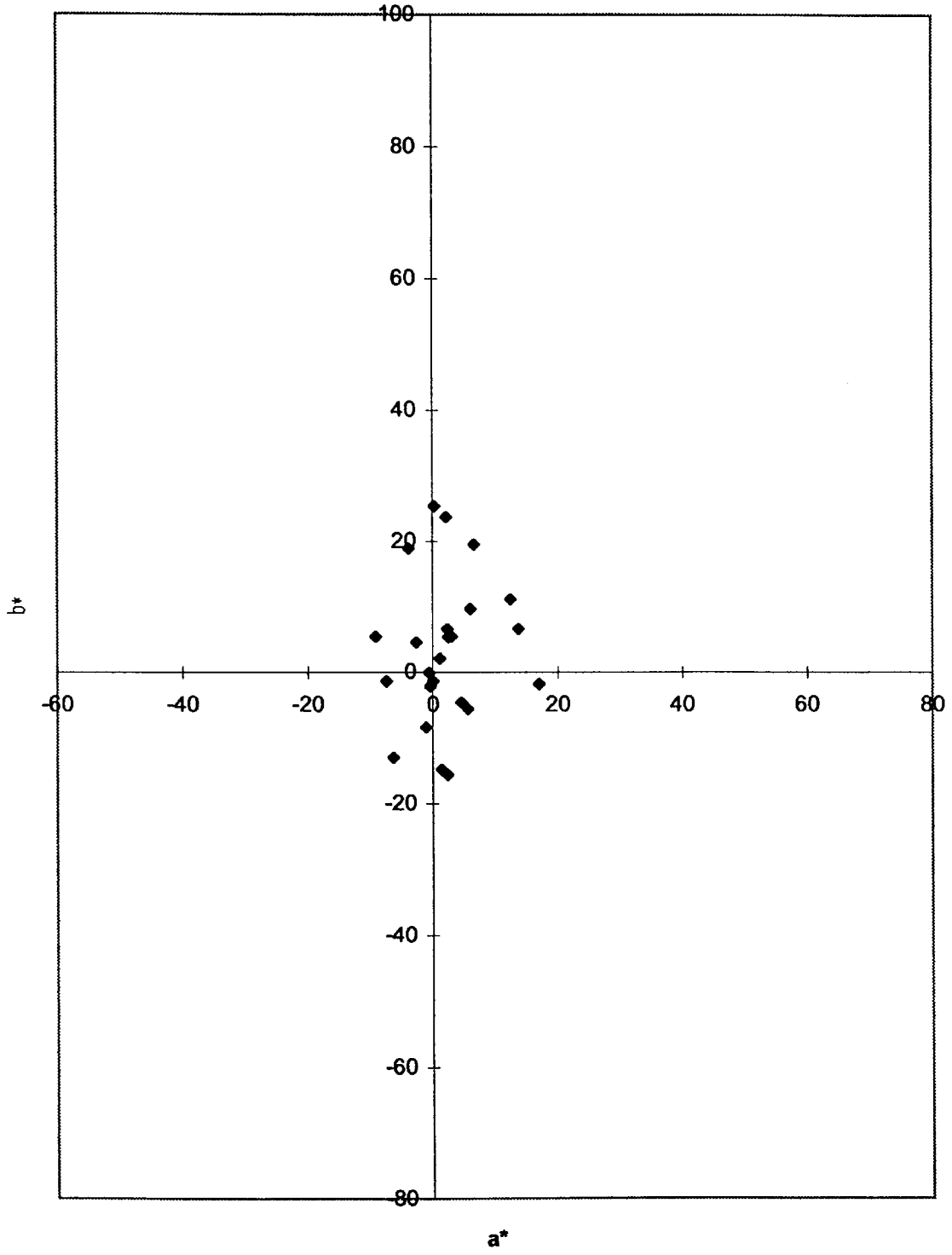
FIG. 10 illustrates the CIELAB plot of a* vs. b* colorimetric color reproduction of a MacBeth ColorChecker printed onto a motion picture print film having a primary dye to secondary dye Equivalent Neutral Density ratio of 2:1 in accordance with Example 104 and processed through the normal ECP-2B process.

Equivalent Neutral Density ratios of primary dye to each secondary dye in each of the dye image-forming units of about 3:1 and 2:1, measured at an exposure resulting in an Equivalent Neutral Density of 1.0 for the primary image dye color of the respective unit, are obtained for Elements 103 and 104, respectively. FIG. 9 illustrates the CIELAB plot of a* vs. b* colorimetric color reproduction of a MacBeth ColorChecker Color Rendition Chart originally photographed on KODAK VISION 500T Color Negative Film 5279™ at a normal exposure which is printed onto Example 103 and processed through the normal ECP-2B process, and FIG. 10 illustrates the CIELAB plot of a* vs. b* colorimetric color reproduction of a MacBeth ColorChecker Color Rendition Chart originally photographed on KODAK VISION 500T Color Negative Film 5279™ at a normal exposure which is printed onto Example 104 and processed through the normal ECP-2B process. In comparison to FIGS. 2 and 8, the non-neutral patches of the MacBeth ColorChecker have moved even more toward the origin of the plot in FIGS. 9 and 10, which represents further desaturations in color reproduction.

The following structures represent compounds utilized in the above described photographic elements.

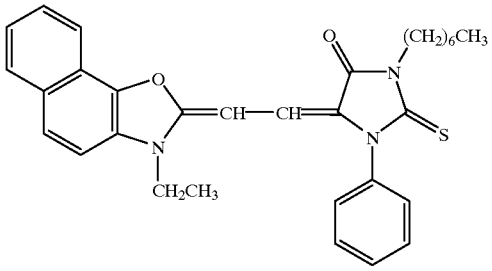

green sensitizing dye cpd 1

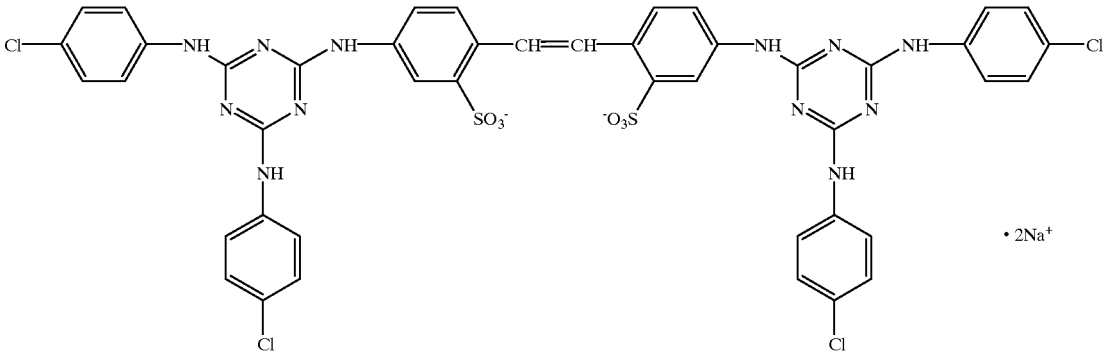

supersensitizer cpd 2

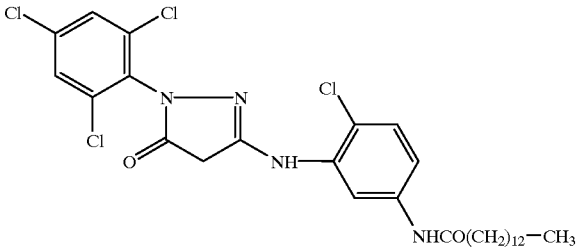

magenta coupler M-1

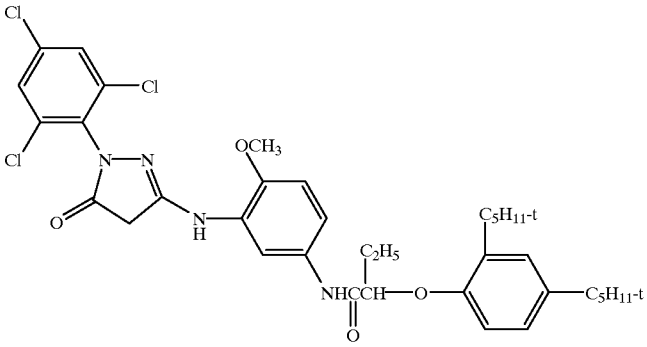

Magenta coupler M-2

-continued
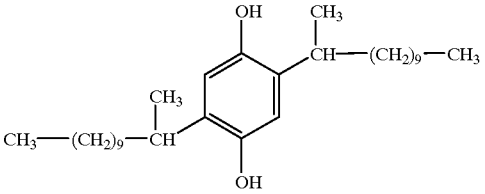
scavenger cpd 3
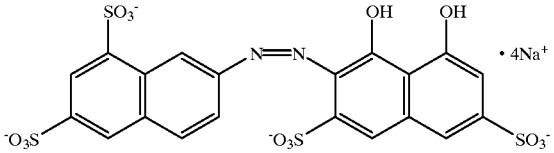
soluble green filter dye #1
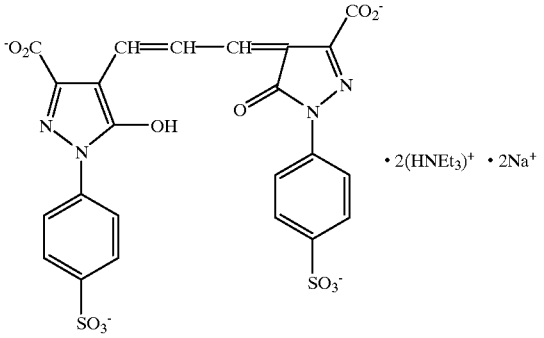
soluble green filter dye #2
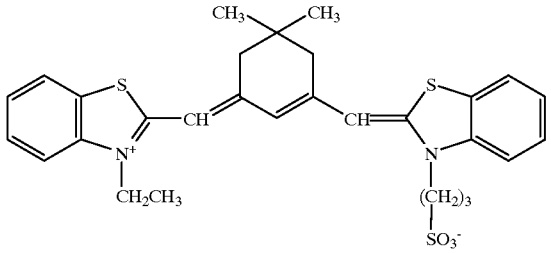
red sensitizing dye cpd 4
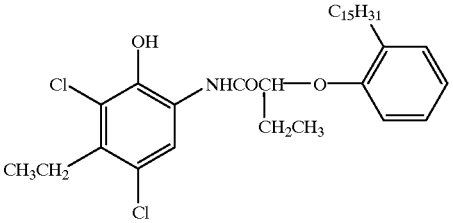
cyan coupler C-1
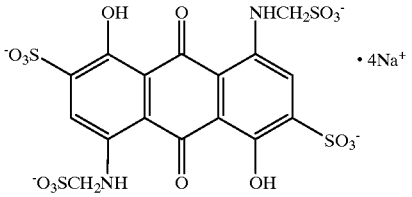
soluble red filter dye #3

-continued
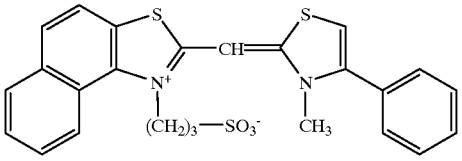
blue sensitizing dye cpd 7
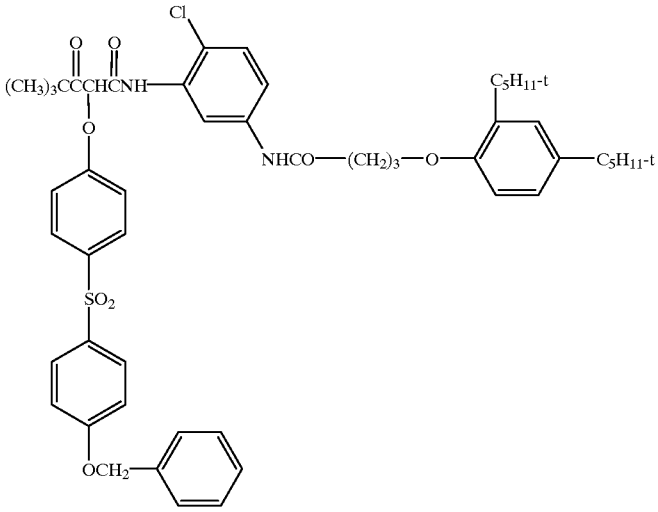
yellow coupler Y-1
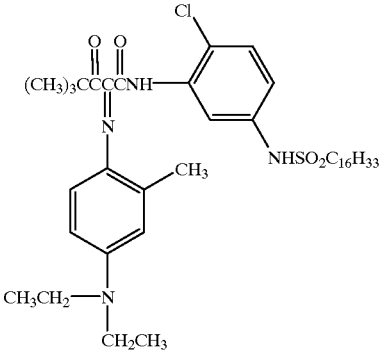
yellow dye cpd 8
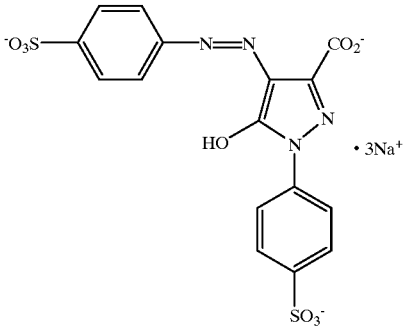
soluble blue filter dye 4
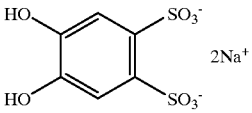
sequestrant cpd 9

-continued

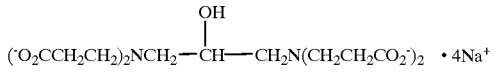

sequestrant cpd 10

While the invention has been described in detail with particular reference to preferred embodiments, it will be understood that variations and modifications can be effected within the spirit and scope of the invention.

We claim:

1. A silver halide light sensitive motion picture photographic print element comprising a support bearing on one side thereof:

a primarily yellow dye image-forming unit comprising at least one blue-sensitive silver halide emulsion layer having associated therewith primary yellow dye-forming coupler and secondary cyan and magenta dye-forming couplers;

a primarily cyan dye image-forming unit comprising at least one red-sensitive silver halide emulsion layer having associated therewith an effectively primary amount of cyan dye-forming coupler and effectively secondary amounts of magenta and yellow dye-forming couplers; and a primarily magenta dye image-forming unit comprising at least one green-sensitive silver halide emulsion layer having associated therewith an effectively primary amount of magenta dye-forming coupler and effectively secondary amounts of cyan and yellow dye-forming couplers;

wherein the primary and secondary dye-forming couplers in each of the dye image-forming units are present in amounts effective to obtain a ratio of Equivalent Neutral Density for the dyes formed from each of the primary dye-forming couplers to each of the secondary dye-forming couplers in each dye-image forming unit of from 20:1 to 3:2 in the print film upon exposure and processing in the standard ECP-2B motion picture color print process, such ratios measured at an exposure resulting in an Equivalent Neutral Density of 1.0 for the primary image dye color of the respective unit.

2. An element according to claim 1, wherein the primary and secondary dye-forming couplers in each of the dye image-forming units are present in amounts effective to obtain a ratio of Equivalent Neutral Density for the dyes formed from each of the primary dye-forming couplers to each of the secondary dye-forming couplers in each dye-image forming unit of from 15:1 to 2:1 in the print film upon exposure and processing in the standard ECP-2B motion picture color print process, measured at an exposure resulting in an Equivalent Neutral Density of 1.0 for the primary image dye color of the respective unit.

3. An element according to claim 1, wherein the primary and secondary dye-forming couplers in each of the dye image-forming units are present in amounts effective to obtain a ratio of Equivalent Neutral Density for the dyes formed from each of the primary dye-forming couplers to each of the secondary dye-forming couplers in each dye-image forming unit of about 10:1 in the print film upon exposure and processing in the standard ECP-2B motion picture color print process, measured at an exposure resulting in an Equivalent Neutral Density of 1.0 for the primary image dye color of the respective unit.

4. An element according to claim 1, wherein the silver halide of each of at least one of the blue-sensitive, red-sensitive, and green-sensitive silver halide emulsion layers comprises silver chloride emulsion grains or silver bromochloride emulsion grains comprising greater than 50 mole % chloride.

5. An element according to claim 4, wherein the silver chloride emulsion grains or silver bromochloride emulsion grains of each layer have an average equivalent circular diameter of less than 1 micron and an aspect ratio of less than 1.3.

6. An element according to claim 4, wherein each of the red-sensitive and green-sensitive silver halide emulsion layers comprise emulsion grains having an average equivalent circular diameter of less than 0.60 micron, and the blue-sensitive silver halide emulsion layer comprises emulsion grains having an average equivalent circular diameter of less than 0.90 micron.

7. A process of forming an image in a motion picture silver halide light sensitive photographic print element according to claim 1 comprising exposing the silver halide light sensitive photographic print element to a color negative film record, and processing the exposed photographic print element to form a developed color image having a ratio of Equivalent Neutral Density for the dyes formed from each of the primary dye-forming couplers to each of the secondary dye-forming couplers in each dye-image forming unit of from 20:1 to 3:2 measured at an exposure resulting in an Equivalent Neutral Density of 1.0 for the primary image dye color of the respective unit.

8. A process according to claim 7, wherein the primary and secondary dye-forming couplers in each of the dye image-forming units are present in amounts effective to obtain a ratio of Equivalent Neutral Density for the dyes formed from each of the primary dye-forming couplers to each of the secondary dye-forming couplers in each dye-image forming unit of from 15:1 to 2:1 in the print film upon exposure and processing.

9. A process according to claim 7, wherein the primary and secondary dye-forming couplers in each of the dye image-forming units are present in amounts effective to obtain a ratio of Equivalent Neutral Density for the dyes formed from each of the primary dye-forming couplers to each of the secondary dye-forming couplers in each dye-image forming unit of about 10:1 in the print film upon exposure and processing.

10. A process according to claim 7, wherein the silver halide of each of at least one of the blue-sensitive, red-sensitive, and green-sensitive silver halide emulsion layers comprises silver chloride emulsion grains or silver bromochloride emulsion grains comprising greater than 50 mole % chloride.

11. A process according to claim 10, wherein the silver chloride emulsion grains or silver bromochloride emulsion grains of each layer have an average equivalent circular diameter of less than 1 micron and an aspect ratio of less than 1.3.

12. A process according to claim 10, wherein each of the red-sensitive and green-sensitive silver halide emulsion layers comprise emulsion grains having an average equivalent circular diameter of less than 0.60 micron, and the blue-sensitive silver halide emulsion layer comprises emulsion grains having an average equivalent circular diameter of less than 0.90 micron.

* * * * *